US011913695B2

(12) United States Patent
Ries et al.

(10) Patent No.: US 11,913,695 B2
(45) Date of Patent: Feb. 27, 2024

(54) ICE-LINED VACCINE REFRIGERATOR

(71) Applicant: B MEDICAL SYSTEMS S.A.R.L., Hosingen (LU)

(72) Inventors: Gilles Ries, Hosingen (LU); Vincent Sadler, Hosingen (LU)

(73) Assignee: B MEDICAL SYSTEMS S.A.R.L., Hosingen (LU)

( * ) Notice: Subject to any disclaimer, the term of this patent is extended or adjusted under 35 U.S.C. 154(b) by 423 days.

(21) Appl. No.: 17/260,593

(22) PCT Filed: Jul. 22, 2019

(86) PCT No.: PCT/EP2019/069646

§ 371 (c)(1),
(2) Date: Jan. 15, 2021

(87) PCT Pub. No.: WO2020/020812

PCT Pub. Date: Jan. 30, 2020

(65) Prior Publication Data

US 2021/0310709 A1 Oct. 7, 2021

(30) Foreign Application Priority Data

Jul. 26, 2018 (GB) ..... 1812202

(51) Int. Cl.
*F25B 49/02* (2006.01)
*F25B 27/00* (2006.01)
(Continued)

(52) U.S. Cl.
CPC ..... *F25B 49/02* (2013.01); *F25B 27/00* (2013.01); *F25D 11/003* (2013.01); *F25D 29/003* (2013.01)

(58) Field of Classification Search
CPC ..... F25B 27/00; F25B 49/02; F25D 11/003; F25D 29/003
See application file for complete search history.

(56) References Cited

U.S. PATENT DOCUMENTS 4,238,930 A * 12/1980 Hogan ..... F25C 5/187 62/158
5,476,763 A 12/1995 Bacchi
(Continued)

FOREIGN PATENT DOCUMENTS

CN 2915733 U 6/2007
CN 204165261 U 2/2015
(Continued)

OTHER PUBLICATIONS

Solar power solar vaccine storage units for remote areas stimulate interest by WWS Charters and YL Oo.
(Continued)

*Primary Examiner* — Henry T Crenshaw
(74) *Attorney, Agent, or Firm* — Jerold I. Schneider; SCHNEIDER IP LAW

(57) ABSTRACT

An ice-lined vaccine refrigerator includes a vaccine storage compartment, an electrically powered cooling circuit, the electrically powered cooling circuit being configured to generate an ice-lining and to cool the vaccine storage compartment; an AC power inlet adapted for connection to an external supply of AC power; and a refrigerant compressor forming part of the electrically powered cooling circuit and adapted to be powered by the external supply of AC power through the AC power inlet. Reliability is improved by using a DC powered compressor and an AC/DC convertor to convert AC power received at the AC power inlet to DC power to power the compressor.

20 Claims, 2 Drawing Sheets

(51) Int. Cl.
*F25D 11/00* (2006.01)
*F25D 29/00* (2006.01)

(56) References Cited

U.S. PATENT DOCUMENTS

| | | | | |
|---|---|---|---|---|
| 9,618,253 | B2 | 4/2017 | Tanslee | |
| 2004/0226309 | A1* | 11/2004 | Broussard | F25D 11/003 62/236 |
| 2006/0107680 | A1* | 5/2006 | Overbeck | F25B 45/00 62/292 |
| 2012/0260677 | A1 | 10/2012 | Ozawa | |
| 2013/0314069 | A1* | 11/2013 | Suzuki | H02J 50/80 323/318 |
| 2015/0311695 | A1* | 10/2015 | West | H02P 27/06 361/33 |
| 2015/0316947 | A1* | 11/2015 | Creekmore | G05F 1/66 700/295 |
| 2016/0268950 | A1* | 9/2016 | Cho | H02P 27/14 |
| 2018/0023876 | A1* | 1/2018 | Müller | F25B 39/02 62/457.9 |

FOREIGN PATENT DOCUMENTS

| | | | |
|---|---|---|---|
| CN | 206207833 | U | 5/2017 |
| JP | 5738207 | B2 | 6/2015 |

OTHER PUBLICATIONS

International Search Report and Written Opinion for corresponding PCT Application.

* cited by examiner

ICE-LINED VACCINE REFRIGERATOR

To ensure their quality, longevity and effectiveness, vaccines must be stored and transported at an optimum storage temperature, generally ≥2° C. and ≤8° C. Exposure to higher or lower (particularly freezing) temperatures causes deterioration of the vaccines. Specialised vaccine storage refrigerators address these and other practical requirements, for example the avoidance of any significant temperature variation between different positions within a vaccine storage chamber.

Particular issues occur for refrigerated vaccine storage where a reliable source of mains electricity is not available. For example, at remote clinics in developing countries which are not connected to the electricity grid, solar power systems are used to power the vaccine refrigerators. Although this provides an effective solution, such systems which require installation and maintenance of solar panels, potentially mounted on masts, and technically advanced refrigeration units, are more complex and more expensive than mains powered vaccine refrigerators. Thus, where mains electricity is available, it is preferred to power vaccine refrigerators from the electricity grid. Unfortunately, in areas of many developing countries where vaccination programs are important, the electricity supply from the available electricity grid is unreliable. Such unreliability may include frequent or prolonged power cuts and/or variations in the mains voltage (for example voltage surges or dips). The issue of frequent or prolonged power cuts has been addressed using ice-lined vaccine refrigerators. Ice-lined refrigerators are configured to generate an ice lining which acts as a thermal capacitor; in the event of a power interruption the pre-formed ice lining absorbs heat from its surroundings and contributes to maintaining the vaccine storage chamber within the desired temperature range. Common ice-lined vaccine refrigerators require availability of mains electrical power during about 8 hours per day for correct operation. The issue of voltage surges and voltage dips is somewhat different. A voltage dip, even if low voltage AC mains power is still available, can effectively reduce the power sup-ply to a level where the ice-lined vaccine refrigerator's compressor cannot function. Voltage surges are also problematic as these can damage the electrical components of the ice-lined vaccine refrigerator. Furthermore, surges caused by starting and stopping of the ice-lined vaccine refrigerator can themselves be problematic. The fact that compressors generally require a higher voltage to start than to run continuously is also problematic. The issue of voltage surges and voltage dips for ice-lined vaccine refrigerators is addressed by systematically installing a voltage stabiliser between the mains supply and the compressor of the ice-lined refrigerator. Whilst this improves the situation, the voltage stablisers used for ice-lined refrigerators are themselves not very reliable, often requiring repair or replacement after two or three years of service. This adds further to the complexity of operating such systems, particularly in remote areas where access to spare parts and/or technical assistance is difficult.

Consequently, there exists a need for improvements in vaccine storage refrigerators to address one or more of these issues.

In accordance with one of its aspects, the present invention provides an ice-lined vaccine refrigerator in accordance with claim 1. Other aspects are defined in independent claims. The dependent claims define preferred or alternative features.

Surprisingly, it has been found that the reliability and operation of an ice-lined vaccine refrigerator which is powered from an AC electrical grid electricity supply may be improved by configuring the ice-lined vaccine refrigerators with: an AC power inlet for connection to the AC electrical grid electricity supply; an AC/DC convertor to transform the AC power input to DC power; and a DC powered compressor of a cooling circuit of the ice-lined refrigerator which is powered by the transformed DC power. This approach to improving the operation and reliability of ice-lined refrigerators is thus completely different to previously proposed concepts of AC mains powered ice-lined refrigerators that rely upon stabilisation of the AC power input to run an AC compressor. The AC electrical grid electricity supply may be the only power source used to power the DC compressor of the cooling circuit. This is preferable for simplification.

The use of a DC compressor, and/or DC components in the compressor circuit, provides high levels of reliability. In particular, highly reliable DC compressors and components which have be developed and tested for solar panel powered vaccine refrigerators provide a useful source of components.

The DC output of the AC/DC convertor may be used to power a DC compressor of the refrigerant cooling circuit. Preferably, the AC/DC convertor is configured to accept an incoming AC voltage provided at the AC power inlet between 90V and 280V at between 50 Hz and 60 Hz and provide an output of 24V DC. The output of the AC/DC converter may be a 12V DC output. The DC output may comprise a ripple; any such ripple is preferably no more than ±2 V or no more than ±10% of the nominal output voltage, more preferably no more than ±1 V or no more than ±5% of the nominal output voltage. The AC/DC convertor may comprise a transformer configured to reduce the voltage of the AC power received at the AC power inlet and/or a rectifier to convert the AC power to DC power and/or a filter to smooth the DC output. Preferably, a relay protects the transformer from too high and/or too low a voltage for desired operation. The ice-lined refrigerator preferably comprises an overvoltage protection relay, for example an overvoltage protection relay having an operational voltage of 150-450V 50/60 Hz AC. The overvoltage protection relay has an upper cut-out voltage, for example 290V; in the case of the supply voltage exceeding the upper cut-out voltage the relay cuts off the power supply to the transformer; in this case the relay may cut off the power supply to the transformer for a pre-set cut-out duration, for example, for two or three minutes. The pre-set cut-out duration is preferably at least 3 minutes; this has been found appropriate in terms of re-stabilisation of the power supply. If after the pre-set cut-out duration the supply voltage has dropped below a re-activation threshold voltage, which may be the upper cut-out voltage, for example below 290V, the relay will re-connect the power supply to the transformer; alternatively, if this is not the case, the relay continues to cut off the power supply to the transformer, for example for a further pre-set cut-out duration, which may be the same duration as the first cut-out duration. Once the supply voltage has dropped below the reactivation threshold voltage, the relay will re-connect the power supply to the transformer. Other forms of overvoltage protection relay may be used, for example involving continuous monitoring of the supply voltage and re-connection of the supply to the transformer upon detection of the supply voltage falling below and/or stabilising below the upper cut-out voltage. Nevertheless, use of an overvoltage relay which includes a pre-set cut-out duration provides a particularly simple and reliable system. Similarly, an undervoltage protection relay having a lower cut-out voltage, for example 160V, may be included and configured to operate in an equivalent way to cut off the power supply to the transformer if the supply voltage falls below the lower cut-out voltage. In addition to preventing exposure of protected electrical components to undesired high voltages the voltage protection relay may be used to reduce the number of starting cycles of the compressor when the AC power supply is unstable; this contributes to reliability of the ice-lined refrigerator.

Housing the AC/DC convertor within a body of the ice-lined vaccine refrigerator provides a compact arrangement and reduces the risk of inadvertent use of an external AC/DC convertor that is not adapted for use with the ice-lined vaccine refrigerator.

The external supply of AC power is preferably a single-phase AC power supply.

The ability to avoid the need for a voltage stabiliser for the electrical grid electricity supply reduces the complexity of the system and improves its reliability.

The ice-lined vaccine refrigerator may be a hybrid vaccine refrigerator, that is to say an ice-lined vaccine refrigerator that can operate on AC power received at its AC power inlet or on DC power received at a DC power inlet or on both. The DC power inlet may be supplied from an external DC power supply, for example from one or more solar panels. Selection between AC, DC or combined AC and DC power input may be selected by the user, for example by activation of a switch. Preferably, where the ice-lined vaccine refrigerator is provided with a DC power inlet in addition to its AC power inlet, selection of one or other or both of the power inlets is made automatically by a control circuit of the ice-lined vaccine refrigerator, for example as a function of the availability and/or stability of each power source and/or as a pre-programmed preference, for example if availability of one of the power supplies is desired to power other equipment. Any such system is preferably arranged such that the ice-lined vaccine refrigerator will always benefit from the power supply in priority over other loads.

As used herein, the term "ice-lined vaccine refrigerator" means a vaccine refrigerator having a vaccine storage compartment and an electrically powered cooling circuit to generate an ice-lining and to cool the vaccine storage compartment and in which the ice lining contributes to providing a holdover time for the ice-lined vaccine refrigerator. The ice lining may comprise a phase change material; it may comprise water with one or more additives; preferably it comprises or consists of water. The ice lining may be arranged within the cooling space, for example as a lining on part of the walls of a cooling space with the vaccine storage compartment being arranged within the same cooling space. The ice lining may comprise water packs, that is to say plastic containers containing water. Preferably, the ice lining is separated from the vaccine storage compartment, notably to avoid the risk of freezing of vaccines stored in the vaccine storage compartment. Such separation may comprise separation by an insulating panel, for example of a foam insulation material, and/or separation by an air gap. In some configurations, the vaccine storage compartment comprises:

- an access surface which provides access to the vaccine storage compartment, notably for placing vaccine in and removing vaccines from the vaccine storage compartment, the access surface being closable with an insulated lid or door;
- a base surface, positioned opposite the access surface; and
- a peripheral surface which extends between the access surface and the base surface;

such that access surface, base surface and peripheral surface together define the boundaries of the vaccine storage compartment.

In a preferred configuration:

- the access surface is substantially horizontal and defines an upper portion of the boundary of the vaccine storage compartment and is closable with a lid, particularly a pivoting lid;
- the base surface defines a lower portion of the boundary of the vaccine storage compartment; and
- the peripheral surface defines sides portions of the boundary of the vaccine storage compartment.

Preferably, the ice-lining is provided adjacent to the peripheral surface of the vaccine storage compartment, notably positioned around substantially the entire peripheral surface, and separated from the peripheral surface solely by: i) one or more solid separators, notably insulation panel(s), for example of a foam material; and/or ii) one or more air gaps.

The ice-lined vaccine refrigerator (referred to as the "appliance") may be subjected to one or more of the following tests.

Cool-down test with continuous power:

- Step 1: Set the test chamber temperature to +43° C. and leave for 48 hours with the appliance empty, the lid or door open and the power supply switched off.
- Step 2: Close the lid or door of the appliance, switch it on and leave it to stabilize.
- Step 3: After stabilization, record temperatures every minute for 24 hours. During this period measure the energy consumption and determine the compressor duty cycle. Measure the duty cycle by timing from the end of one cycle to the end of a corresponding cycle approximately 24 hours later. Calculate the percentage 'on' time over this period. Measure electricity consumption over the same time scale and report as kWh/day.

Acceptance criterion which the ice-lined vaccine refrigerator preferably meets: Stabilized internal temperatures between +2° C. and +8° C. in the vaccine storage compartment achieved within the test period (after stabilization).

Stable running and power consumption test with continuous power:

- Step 1: When the internal temperature is stabilized at the end of the Cool-down test, load the appliance with simulated, pre-conditioned vaccine.
- Step 2: Close the lid or door of the appliance and leave it to stabilize.
- Step 3: After temperature stabilization has been achieved, record temperatures every minute for 24 hours. During this period measure the energy consumption and determine the compressor duty cycle. Measure the duty cycle by timing from the end of one cycle to the end of a corresponding cycle approximately 24 hours later. Calculate the percentage 'on' time over this period. Measure electricity consumption over the same time scale and report as kWh/day.

Acceptance criterion which the ice-lined vaccine refrigerator preferably meets: Internal temperatures maintained between +2° C. and +8° C. in the vaccine storage compartment.

Stable running and power consumption test with intermittent power.

- Step 1: Continue the "Stable running and power consumption test with continuous power" conditions and temperature monitoring regime, but cycle the power supply 8 hours on and 16 hours off until the temperature has re-stabilized and a minimum of three repeating 24 hour temperature profile cycles have been completed.

Step 2: From the start of the next 8 hour power-on cycle, measure the energy consumption and determine the compressor duty cycle. Measure the duty cycle by timing from the start of the power-on cycle to the end of a corresponding cycle approximately 8 hours later. Calculate the percentage 'on' time over this period. Measure and report electricity consumption over the same time scale and report as kWh/day.

Acceptance criterion which the ice-lined vaccine refrigerator preferably meets: Internal temperatures maintained between +2° C. and +8° C. in the vaccine storage compartment.

In an alternative, but otherwise similar test, Step 1 is carried out with an alternative on/off cycle configured with up to 20 hours on and at least 4 hours off.

Holdover time test with intermittent power.

Step 1: Continue the "Stable running and power consumption test with intermittent power" conditions.

Step 2: Cycle the power supply 8 hours on and 16 hours off until the temperature has re-stabilized and the repeating 24 hour temperature profile from the "Stable running and power consumption test with intermittent power" has been re-established.

Step 3: At the end of the next 8 hour power-on cycle switch off the power supply. If the compressor has already cycled off at this point record the elapsed time since the end of the previous compressor-on cycle (t)

Step 4: Monitor the temperature of the vaccine load at one minute intervals. At the moment when the warmest point in the load exceeds+10° C. record the elapsed time since power supply switch off and add this to the value 't' recorded in Step 3. Record the position of the warmest point.

Acceptance criterion which the ice-lined vaccine refrigerator preferably meets: More than 20 hours, preferably more than 40 hours, more preferably more than 80 hours at a continuous ambient temperature of +43° C.

Day/night test with intermittent power.

Step 1: Stabilize the test chamber at +43° C. Load the appliance with simulated, pre-conditioned vaccine.

Step 2: Switch the appliance on, initially with continuous power, and stabilize the vaccine load temperature between +2° C. and +8° C. Allow to run for a further 24 hrs.

Step 3: Start the intermittent power cycle by disconnecting the power for the next 16 hours. Simultaneously begin the day/night cycle by reducing the temperature of the test chamber to +25° C. over a 3-hour period. Hold this temperature for 9 hours. Raise the temperature to +43° C. over a 3-hour period. Hold at +43° C. for a further 9 hours. Reduce again to +25° C. again over a further 3 hr period. Repeat this simulated day/night temperature and 16 hour power-off, eight hour power-on cycle five times. Record the vaccine load temperature every minute.

Step 4: Review the data and calculate the mean kinetic temperature (MKT) for each sensor over the five day period.

Step 5: Record the highest and lowest temperatures reached during the test. Acceptance criterion which the ice-lined vaccine refrigerator preferably meets: Vaccine load temperatures remain within the acceptable temperature range throughout the test and the MKT of the worst case sensor is not be outside the range +2° C. to +8° C.

Preferably, the ice-lined vaccine refrigerator meets the acceptance criteria for each of the aforementioned tests.

Where the acceptance criteria for one of the aforementioned test includes an Acceptable temperature range which is ≥2° C. and ≤8° C., the requirements for the Acceptable temperature range are considered to be met despite possible transient excursions outside this range provided that: a) no excursion exceeds +20° C.; and b) no excursion reaches 0° C.; and c) the cumulative effect of any excursions within the above range assessed over a five day period of a day/night test results in a calculated mean kinetic temperature (MKT) within the range +2° C. to +8° C. when the default activation energy is set at 83,144 kJ per mol. For (c), the cumulative effect of any excursions, the mean kinetic temperature (MKT) is assessed with reference to Seevers, R. et al. The Use of Mean Kinetic Temperature (MKT) in the Handling, Storage and Distribution of Temperature Sensitive Pharmaceuticals. Pharmaceutical Outsourcing, May/June 2009 and using the recorded temperature data, an MKT figure will be calculated for each sensor with the worst-case result determining the outcome of the test. To meet the requirements for the Acceptable temperature range an entire vaccine load must remain within the acceptable temperature range during any continuous ambient temperature test(s) or day/night cycling temperature test(s).

The compressor is configured to compress a refrigerant of the cooling circuit; the refrigerant may be a HFC (hydro fluorocarbon) or a HC (hydrocarbon) refrigerant; a preferred refrigerant is R134a. Preferably, the refrigerant is free from CFCs (chlorofluorocarbons) and HCFCs (hydrochlorofluorocarbons).

The volume of the vaccine storage compartment may be between 15 L and 260 L; this provides for storage or a suitable quantity of vaccines. It may be ≥40 L, ≥50 L or ≥55 L and/or ≤100 L, ≤90 L or ≤85 L.

An embodiment of the invention will now be described, by way of example only, with reference to the accompanying drawings, of which:

Figure 1:
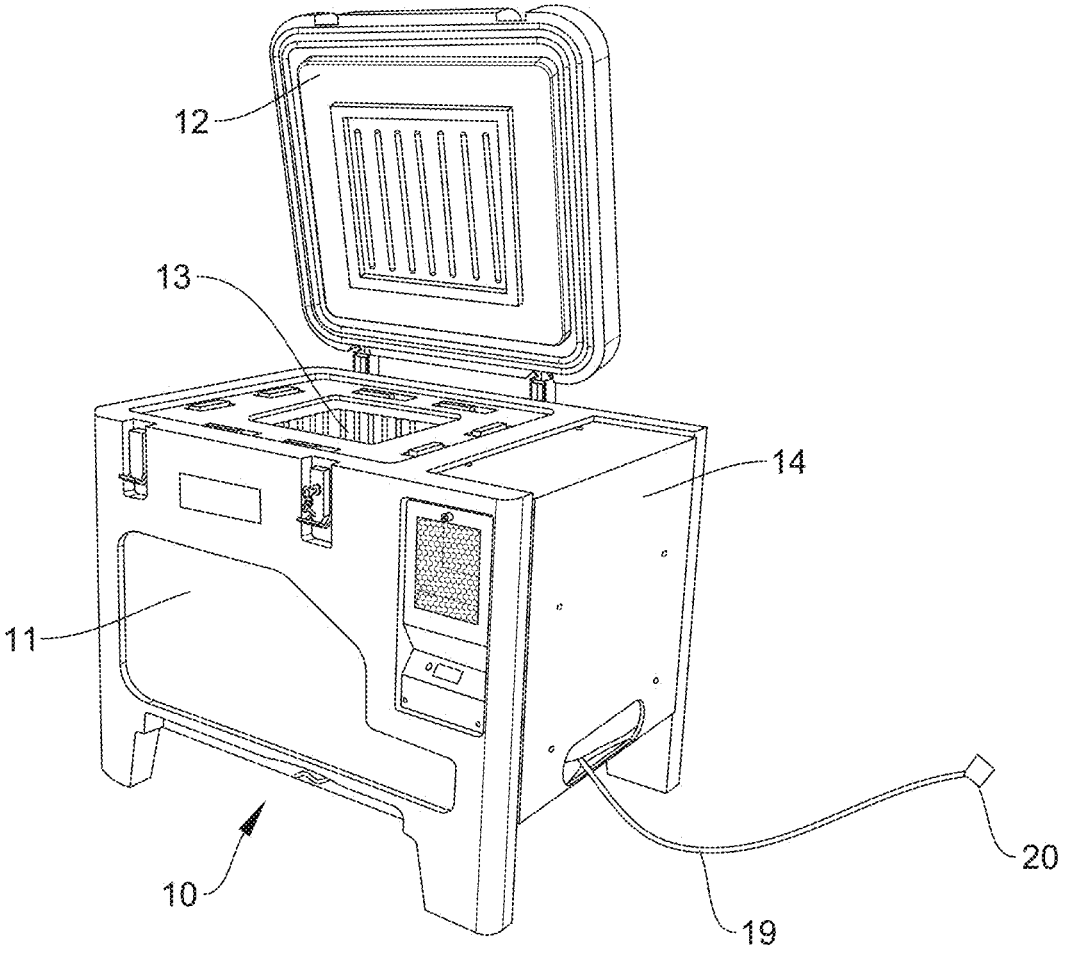
FIG. 1 is a schematic perspective view of an ice-lined vaccine refrigerator.
Figure 2:
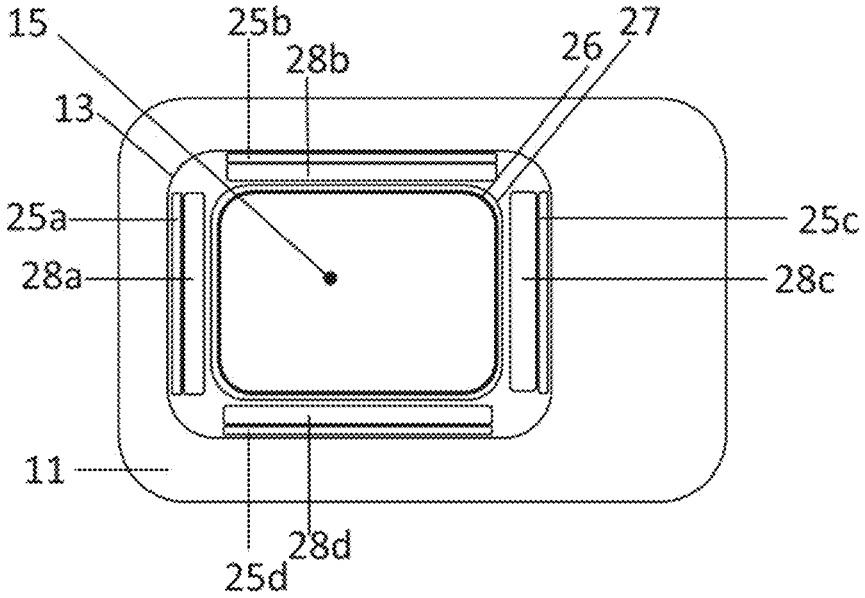
FIG. 2 is a schematic top view (without the lid) of the ice-lined vaccine refrigerator.
Figure 3:
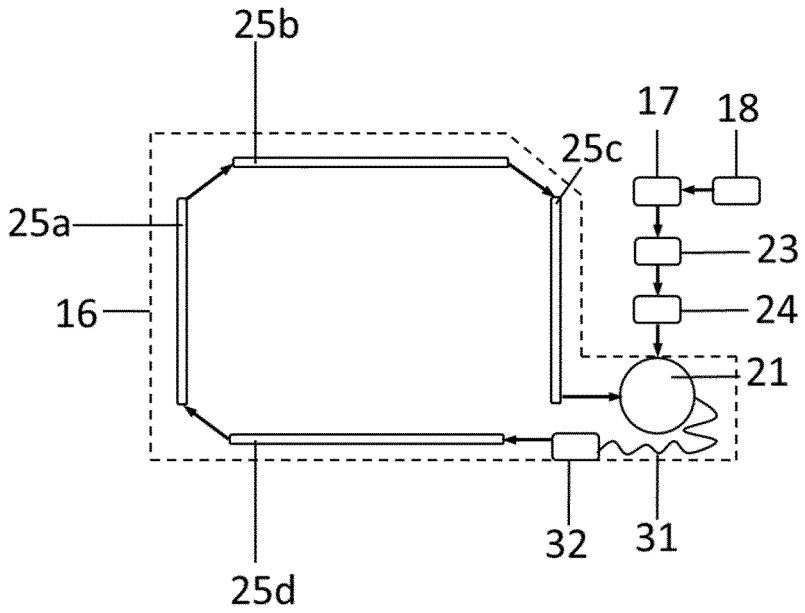
FIG. 3 is a schematic view of electrical components and of the electrically powered cooling circuit of the ice-lined vaccine refrigerator.

The ice-lined vaccine refrigerator 10 comprises an insulated, moulded body 11 having an insulated pivoted lid 12. A cooling space 13 within the body 11 is accessible when the lid 12 is open and sealable by closing of the lid 12. Electrical components and control circuitry of the refrigerator 10 are arranged within a component housing 14 which is incorporated into the mounded body 11.

In particular, the ice-lined vaccine refrigerator 10 comprises:

- a vaccine storage compartment 15 within the cooling space 13;
- an electrically powered cooling circuit 16,
- an AC power inlet 17 adapted for connection to an external supply of AC power provided from an electricity grid 18 by a power cable 19 fitted with an electrical plug 20 adapted for the intended country of use; and
- a compressor 21 forming part of an electrically powered cooling circuit 16 of the vaccine refrigerator 10.

The compressor 21 is powered indirectly from the AC electricity grid 18 through the AC power inlet 17. The AC power inlet 17 is connected to the input of an overvoltage protection relay 23 with the outlet of the overvoltage protection relay 23 being connected to the input of a combined transformer and AC/DC convertor 24. The overvoltage protection relay 23 has an operational voltage of 150-450V 50/60 Hz AC; whenever the supply voltage received at the AC power inlet exceeds 290V, the relay cuts off the power supply to the transformer for at least 180 s. If after 180 s the supply voltage has dropped below 290V, it will switch back the power supply, and otherwise keep on waiting. The transformer and AC/DC convertor 24 is configured to operate with an input from the AC power inlet 17 in the range 100-240 V AC 50/60 Hz, 3.0 A and to provide an output to the compressor 21 of +24 V DC, 10 A.

The electrically powered cooling circuit 16 comprises: four flat plate evaporators 25*a*, 25*b*, 25*c*, 25*d*, each arranged at a peripheral side wall of the cooling space 13, the evaporators being fed with refrigerant which is circulated by the compressor 21 through a condenser 31, subsequently through an expansion valve 32 and subsequently through the evaporators before returning to the compressor 21. A separator plate 26 is arranged within the cooling space 13, the internal periphery of the separator plate 26 defining the side walls of the vaccine storage compartment 15. The separator plate 26 comprises a metal sheet, notably an aluminium sheet, having a thickness of 1-2 mm, provided with a layer of insulation 27, notably a sheet of polystyrene, covering each of its surfaces which faces an evaporator plate 25*a*, 25*b*, 25*c*, 25*d*. An ice pack 28*a*, 28*b*, 28*c*, 28*d* is arranged in each of the spaces between the evaporator plates 25*a*, 25, 25*c*, 25*d* and the separator plate 26. In operation, the electrically powered cooling circuit 16 freezes the icepacks 28*a*, 28*b*, 28*c*, 28*d* which generates an ice lining and cools the vaccine storage compartment 15.

The arrangement of the insulated separator plate 26 between the ice packs 28*a*, 28*b*, 28*c*, 28*d* and the vaccine storage compartment 15 reduces the risk of undesirably cooling the vaccine storage compartment 15 to a temperature of below +2° C. Furthermore, a separate heating system (not shown) and associated control system is provided to raise the temperature of the vaccine storage compartment 15 if needed; this provides a safeguard to ensure that the temperature of the vaccine storage compartment 15 does fall below +2° C.

Figure 4:
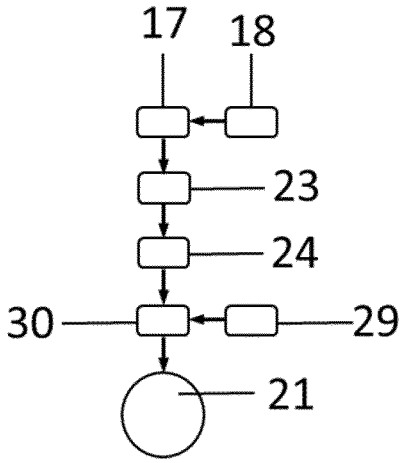
FIG. 4 is a schematic view of an alternative arrangement of electrical components.

In the arrangement illustrated in FIG. 4, ice-lined refrigerator 10 further comprises a DC power inlet 29 configured to receive DC power from an external DC power source, for example a 24 V DC supply from one or more solar panels, as an auxiliary power supply to power the DC compressor. The DC power inlet in this case may comprise an electrical socket compatible with, preferably only compatible with, a specified DC power supply. An associated protection or cut-out circuit may be provided to avoid component damage in the event of the DC inlet being connected to an inappropriate power supply. In the illustrated arrangement, a power selector relay 30 receives power inlets from each of the DC power inlet 29 and the AC power inlet 17, the input from the AC power inlet 17 preferably being received indirectly after passage through the overvoltage protection relay 23 and transformation to DC power by the combined transformer and AC/DC convertor 24. The compressor 21 in this case can be powered by the power selector relay 30 on the basis of i) only power from the AC power inlet 17; ii) only power from the DC power inlet 29 or iii) power from both the AC power inlet 17 and the DC power inlet 29. The selection of the power source for the compressor in this case may be made using appropriate control circuitry.

LIST OF REFERENCE NUMBERS

10 ice-lined vaccine refrigerator
11 moulded body
12 lid
13 cooling space
14 component housing
15 vaccine storage compartment
16 electrically powered cooling circuit
17 AC power inlet
18 electricity grid
19 power cable
20 electrical plug
21 compressor
22 electrically powered cooling circuit
23 overvoltage protection relay
24 transformer and AC/DC convertor
25*a* evaporator
25*b* evaporator
25*c* evaporator
25*d* evaporator
26 separator plate
27 insulation
28*a* ice pack
28*b* ice pack
28*c* ice pack
28*d* ice pack
29 DC power inlet
30 power selector relay
31 condenser
32 expansion valve

The invention claimed is:

1. An ice-lined vaccine refrigerator comprising:
a vaccine storage compartment;
an electrically powered cooling circuit, the electrically powered cooling circuit being configured to generate an ice-lining and to cool the vaccine storage compartment;
an AC power inlet adapted for connection to an external supply of AC power; and
a compressor forming part of the electrically powered cooling circuit and adapted to be powered by the external supply of AC power through the AC power inlet;
in which the compressor is a DC powered compressor; and
in which the ice-lined refrigerator comprises an AC/DC convertor configured to convert AC power received at the AC power inlet to DC power which powers the compressor.

2. The ice-lined vaccine refrigerator of claim 1, in which the AC/DC convertor is housed within a body of the ice-lined vaccine refrigerator.

3. The ice-lined vaccine refrigerator of claim 1, in which the AC/DC convertor comprises a transformer configured to reduce the voltage of the AC power received at the AC power inlet and a rectifier to convert the AC power to DC power.

4. The ice-lined vaccine refrigerator of claim 3, in which an overvoltage protection relay is arranged between the i) AC power inlet and ii) the transformer and rectifier, the overvoltage protection relay being configured to disconnect the transformer and rectifier from the supply voltage in the case of the supply voltage exceed an upper cut-out voltage.

5. The ice-lined vaccine refrigerator of claim 1, in which the compressor and the AC/DC converter are configured such that the compressor is operable on the basis of an external supply of AC power is anywhere within the range of 90 V to 280 V and 50-60 Hz.

6. The ice-lined vaccine refrigerator of claim 1, in which the external supply of AC power is an electrical grid electricity supply.

7. The ice-lined vaccine refrigerator of claim 6, in which the electrical grid electricity supply is provided to the AC power inlet without passing through a voltage stabilizer.

8. The ice-lined vaccine refrigerator of claim 1, in which the DC powered compressor is operable on the basis of a DC compressor inlet voltage which is anywhere within the range 20 V to 28 V.

9. The ice-lined vaccine refrigerator of claim 1, in which the ice-lined vaccine refrigerator further comprises a DC power inlet configured to receive DC power from an external DC power source to power the DC compressor.

10. The ice-lined vaccine refrigerator of claim 9, in which the DC power inlet is configured to receive a DC voltage anywhere in the range of 10 V to 28 V to power the compressor.

11. The ice-lined vaccine refrigerator of claim 9, in which the ice-lined refrigerator comprises an automated electronic circuitry configured to select the power source for the compressor between i) the AC power inlet, ii) the DC power inlet, and iii) a combination of the AC power inlet and the DC power inlet.

12. The ice-lined vaccine refrigerator of claim 1, in which the ice-lined vaccine refrigerator is configured to i) ensure that, during operation, the temperature in the vaccine storage compartment is ≥2° C. and ≤8° C. and ii) to ensure a hold-over time of at least 20 hours.

13. The ice-lined vaccine refrigerator of claim 6, in which the AC electrical grid electricity supply is the only power source used to power the DC powered compressor of the electrically powered cooling circuit.

14. The ice-lined vaccine refrigerator of claim 7, in which the AC electrical grid electricity supply is the only power source used to power the DC powered compressor of the electrically powered cooling circuit.

15. The ice-lined vaccine refrigerator of claim 9, in which the external DC power source comprises one or more solar panels.

16. An ice-lined vaccine refrigerator comprising:

a vaccine storage compartment;

an electrically powered cooling circuit, the electrically powered cooling circuit which generates an ice-lining and cools the vaccine storage compartment;

an AC power inlet connected to an external supply of AC power; and a compressor forming part of the electrically powered cooling circuit, the compressor being powered by the external supply of AC power through the AC power inlet;

in which:

the compressor is a DC powered compressor;

the ice-lined refrigerator comprises an AC/DC convertor which converts AC power received at the AC power inlet to DC power which powers the compressor;

the AC/DC convertor comprises a transformer which reduce the voltage of the AC power received at the AC power inlet and a rectifier which converts the AC power to DC power;

the ice-lined vaccine refrigerator further comprises an overvoltage protection relay arranged between i) the AC power inlet and ii) the transformer and rectifier, the overvoltage protection relay being configured to disconnect the transformer and rectifier from the supply voltage in the case of the supply voltage exceeding an upper cut-out voltage;

the compressor and the AC/DC converter are configured such that the compressor is operable when the external supply of AC power 1 s anywhere within the range of 90 V to 280 V and 50-Hz;

the external supply of AC power is an electrical grid electricity supply provide to the AC power inlet without passing through a voltage stabilizer; and the electrical grid electricity supply is the only power source used to power the DC powered compressor of the electrically powered cooling circuit.

17. The ice-lined vaccine refrigerator of claim 16, in which the electrical grid electricity supply is an unreliable electrical grid AC electricity supply.

18. The ice-lined vaccine refrigerator of claim 1, in which the electrically powered cooling circuit is a battery free electrically powered cooling circuit.

19. The ice-lined vaccine refrigerator of claim 1, in which the ice-lined vaccine refrigerator comprises an ice lining which is separated from the vaccine storage compartment by an insulating panel.

20. The ice-lined vaccine refrigerator of claim 1, in which the electrically powered cooling circuit comprises an evaporator arranged at a peripheral side wall of the vaccine cooling compartment and the ice-lined vaccine refrigerator comprises an ice pack arranged between the evaporator and the vaccine storage compartment and in which, in operation, the evaporator freezes the ice-pack to generate the ice lining.

* * * * *